US009614311B2

(12) United States Patent
Duenkel et al.

(10) Patent No.: US 9,614,311 B2
(45) Date of Patent: Apr. 4, 2017

(54) ARRANGEMENT FOR ELECTRICAL CONTACTING AND PLUG TYPE CONNECTION COMPRISING SUCH AN ARRANGEMENT AND METHOD FOR JOINING SUCH AN ARRANGEMENT TO A COUNTER-ARRANGEMENT

(71) Applicant: Tyco Electronics AMP GmbH, Bensheim (DE)

(72) Inventors: Dirk Duenkel, Bensheim (DE); Michael Schall, Heppenheim/Sonderbach (DE); Gregor Panitz, Soergenloch (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/288,279

(22) Filed: May 27, 2014

(65) Prior Publication Data

US 2014/0357136 A1 Dec. 4, 2014

(30) Foreign Application Priority Data

May 29, 2013 (DE) ..... 10 2013 210 122

(51) Int. Cl.

| | |
|---|---|
| ***H01R 13/15*** | (2006.01) |
| ***H01R 13/05*** | (2006.01) |
| ***H01R 12/87*** | (2011.01) |
| *H01R 12/72* | (2011.01) |

(52) U.S. Cl.

CPC ..... *H01R 13/05* (2013.01); *H01R 12/87* (2013.01); *H01R 12/721* (2013.01); *Y10T 29/49208* (2015.01)

(58) Field of Classification Search

CPC ... H01H 85/202; H01R 4/5083; H01R 23/684
USPC ..... 439/260, 267, 635
See application file for complete search history.

(56) References Cited

U.S. PATENT DOCUMENTS

| | | | | |
|---|---|---|---|---|
| 4,060,300 | A * | 11/1977 | Jayne | H01R 12/89 439/267 |
| 4,077,688 | A * | 3/1978 | Cobaugh | H01R 12/88 439/267 |
| 4,085,990 | A * | 4/1978 | Jayne | H01R 12/89 439/267 |
| 4,695,111 | A * | 9/1987 | Grabbe | H01R 12/88 439/260 |

(Continued)

*Primary Examiner* — Abdullah Riyami
*Assistant Examiner* — Thang Nguyen
(74) *Attorney, Agent, or Firm* — Faegre Baker Daniels LLP

(57) ABSTRACT

The invention relates to an arrangement for electrical contacting and a plug type connection comprising such an arrangement. The invention further relates to a method for joining an arrangement for electrical contacting to a counter-arrangement. An object of the invention is to provide an arrangement for electrical contacting, in which the risk of damage is as small as possible. This object is achieved by an arrangement for electrical contacting which comprises a resiliently redirectable contact arm having a contact face and a counter-element which can be displaced parallel with the contact arm, wherein the counter-element is displaced with respect to a start position (A) in a contact position (K) and the contact arm is thereby resiliently redirected transversely relative to the displacement direction (M) of the counter-element.

16 Claims, 3 Drawing Sheets

(56) References Cited

U.S. PATENT DOCUMENTS

| | | | | |
|---|---|---|---|---|
| 6,004,151 | A * | 12/1999 | Hashiguchi | H01R 12/89 439/260 |
| 6,132,224 | A * | 10/2000 | Murakami et al. | 439/77 |
| 6,213,804 | B1 * | 4/2001 | Matsumura | H01R 12/87 439/267 |
| 6,416,342 | B2 * | 7/2002 | Matsumura | H01R 12/87 439/267 |
| 6,494,781 | B2 * | 12/2002 | Fujita | H01R 12/721 439/260 |
| 6,572,396 | B1 * | 6/2003 | Rathburn | H01R 12/89 439/260 |
| 7,004,776 | B2 * | 2/2006 | Otsu et al. | 439/266 |
| 7,014,487 | B2 * | 3/2006 | Ishikawa | H01R 13/055 439/267 |
| 7,338,303 | B1 * | 3/2008 | Yi et al. | 439/267 |
| 7,390,208 | B1 * | 6/2008 | Sabo | H01R 12/57 439/260 |
| 7,527,513 | B1 * | 5/2009 | Okuyama et al. | 439/267 |
| 7,563,118 | B1 * | 7/2009 | McCauley | H01R 13/533 439/260 |
| 7,628,654 | B2 * | 12/2009 | Hori et al. | 439/637 |
| 7,654,845 | B2 * | 2/2010 | Buschle | H01R 12/721 439/260 |
| 8,641,438 | B2 * | 2/2014 | Kamiya | H01R 12/721 439/260 |
| 8,905,773 | B2 * | 12/2014 | Liang | H01R 12/87 439/260 |
| 2015/0155645 | A1 * | 6/2015 | Hara | H01R 12/714 439/345 |

* cited by examiner

ARRANGEMENT FOR ELECTRICAL CONTACTING AND PLUG TYPE CONNECTION COMPRISING SUCH AN ARRANGEMENT AND METHOD FOR JOINING SUCH AN ARRANGEMENT TO A COUNTER-ARRANGEMENT

CROSS-REFERENCE TO RELATED APPLICATION

This application claims priority to German Application Serial No. DE 10 20 13 210 122.8 (DE 10 2013 210 122.8), filed May 29, 2013, titled "Arrangement for Electrical Contacting and Plug Type Connection Comprising such an Arrangement and Method for Joining such an Arrangement to a Counter-arrangement," "the disclosure of which is expressly incorporated herein by reference."

BACKGROUND

The invention relates to an arrangement for electrical contacting and a plug type connection comprising such an arrangement. The invention further relates to a method for joining an arrangement for electrical contacting to a counter-arrangement.

SUMMARY

An object of the invention is to provide an arrangement for electrical contacting in which the risk of damage is as low as possible.

This object is achieved with an arrangement for electrical contacting which comprises a resiliently redirectable contact arm having a contact face and a counter-element which can be displaced parallel with the contact arm, the counter-element being displaced with respect to a start position in a contact position and the contact arm thereby being resiliently redirected transversely relative to the displacement direction of the counter-element.

In the solution according to the invention, the contact arm is remote from a counter-contact in the start position and is only redirected by the displacement of the counter-element onto the counter-contact face. In methods according to the invention, at least one contact face is placed on a counter-contact face of the counter-contact arrangement, preferably by the contact arm being redirected transversely relative to the displacement direction and being pressed onto the counter-contact. The contact face and also the counter-contact face thereby become less scratched and/or scraped or not at all scratched and/or scraped, which reduces the risk of damage.

The solution according to the invention can be further improved by means of the following developments and embodiments which are advantageous per se and which can be freely combined with each other.

The counter-element may be displaceably retained on the contact arm in order to enable joining together in the most simple manner possible. It can be displaceably retained directly or indirectly on the contact arm. It may be displaceably retained on a housing of the arrangement. In particular, the counter-element may be displaceably retained on the contact arm in a non-releasable manner. In another embodiment, the counter-element may be arranged on a counter-arrangement, for example, a counter-connector or a printed circuit board. The counter-element may be arranged on an intermediate element which can be fitted between the arrangement and a counter-arrangement.

The arrangement may have a contact element, which has the contact arm and side walls which cover the contact arm in the start position. The side walls serve to protect the contact arm, in particular when the contact element is pushed together with a counter-arrangement or when the contact element is introduced into a connector. To this end, the side walls may project beyond the contact arm laterally and/or in a downward direction and in an upward direction. In the contact position, at least one contact face may protrude beyond the side walls.

Alternatively or in addition, the arrangement may comprise a contact element which has the contact arm and a protection element which, in the start position, covers the contact face when viewed in an insertion direction and/or in a displacement direction. The contact face is thereby protected from damage in the insertion direction and/or in the displacement direction, that is to say, in a forward direction, when the contact element is introduced, for example, into a connector housing and when the counter-element is advanced. In the contact position, at least the contact face may no longer be covered by the protection element and may produce a contact laterally. The protection element may, for example, be constructed as a protection wall. This may be formed in a simple manner from a metal sheet, for instance, by means of bending.

A contact element having a contact arm may comprise a contact housing, the contact arm being located inside the contact housing in the start position. The contact housing can protect the contact arm towards one or more sides. In particular, it may protect it in the direction of all the sides. The contact housing may protect the contact arm when it is connected to a counter-arrangement or when the contact element is introduced into a connector. The contact housing may in particular have the above-mentioned side walls and the protection element. In a start position, the contact arm may be located inside a cubing of the contact housing. In the contact position, at least the contact face may protrude from the housing, in particular from a cubing of the housing, in order to be able to produce an electrical contact.

The side walls, the protection element and/or the contact housing may be integral with the contact arm. For example, it may be a punched and bent contact element.

In order to achieve automatic redirection, the contact arm may have a redirection portion which extends in an oblique manner relative to the displacement direction and which can be redirected relative to a base, the counter-element being advanced onto the redirection portion in the contact position. Owing to the advance of the counter-element, the redirection portion and the contact arm are resiliently redirected transversely relative to the displacement direction of the counter-element, placed on the counter-contact and a contact is thereby produced.

The redirection portion can be located partially or completely in a contact housing in the start position. In the contact position, the redirection portion may be located at least partially outside the contact housing.

The contact face may be connected to the redirection portion, or be arranged thereon. For example, it may be located at an end of the redirection portion.

The contact arm may have a pivot portion which is articulated to a base by means of a curved portion. This may be located in the contact housing in the start position and the contact position. A pivoting and consequently redirection of the contact face and the contact arm may be facilitated by means of the pivot portion. The pivot portion may adjoin a redirection portion, for example, may be articulated thereto by means of a curved portion. The pivot portion may be arranged between the redirection portion and the base. In particular, the pivot portion may extend in a direction counter to a redirection portion. The pivot portion may, for example, also extend in an oblique manner, but with an opposing angle relative to the displacement direction. It may, for example, extend substantially perpendicularly relative to the redirection portion.

The redirection portion and the pivot portion may together form a V-shape whose tip faces the contact face transversely relative to the displacement direction. Owing to the V shape, a compact construction is achieved. At the tip of the V, at least in the contact position, a redirection of the contact arm may be carried out. With a correspondingly formed counter-face which extends parallel with the displacement direction, the contact face in the contact position is redirected to a uniform extent and with a consistent force, regardless of whether a counter-arrangement is displaced to a greater or lesser extent in the displacement direction relative to the arrangement. In an alternative embodiment, a counter-face may also extend in an oblique manner so that the contact face is pressed to an increasing or decreasing extent as the displacement increases.

The arrangement may have a connection portion for connection to a cable. In particular, such a connection portion may be constructed as a crimp portion. A simple connection is thereby possible.

The arrangement may have two contact arms, the contact faces in the start position being spaced further apart from each other than in the contact position. With an arrangement which is constructed in this manner, a counter-arrangement can be introduced between the contact faces without the counter-arrangement and the contact faces becoming mutually damaged during the introduction operation. Only shortly before reaching the contact position, the contact arms and the contact faces can be redirected transversely relative to the insertion direction and pressed onto the counter-arrangement. In an advantageous embodiment, the contact arms face each other with respect to the displacement direction. In the contact position, the two contact arms can at least partially perform a retention function by clamping the counter-arrangement.

When two contact arms are present, both contact arms can be redirected with the same counter-element. A simple production and assembly is thereby achieved. Such a counter-element may, for example, be sleeve-like or carriage-like. It may, for example, be displaceably arranged between the counter-arrangement and the arrangement. Alternatively, for example, it may be arranged on the counter-arrangement in a rigid manner. In particular, two contact arms whose contact faces are spaced further apart from each other in the start position than in the contact position, for example, two contact arms which face each other with respect to the displacement direction, may be redirected by the same counter-element. Owing to the displacement of the counter-element, a counter-arrangement can then be clamped.

The counter-element may be rigidly connected to a securing device, in particular a contact securing means. In particular, it may be integral with the counter-element. Such a counter-element may thus perform a dual function and be used not only to redirect the contact arm, but also for securing, for example, in a connector housing.

The arrangement according to the invention may be part of an electrical connector. The connector may, for example, further have other elements, such as a connector housing.

A plug-type connection according to the invention comprises an arrangement and a counter-arrangement.

In an advantageous embodiment of a plug type connection, the counter-element is rigidly connected to a stop for the counter-arrangement. When the plug type connection according to the invention is joined together, the counter-arrangement may be in abutment with the stop. In the event of further displacement, owing to the rigid connection, the counter-element is automatically also displaced and the contact arm is automatically redirected. A contact is thereby automatically produced during the displacement.

With a method according to the invention for joining an arrangement for electrical contacting to a counter-arrangement, at least one contact face of the arrangement is placed on a counter-contact face of the counter-arrangement. In this instance, the contact faces of the arrangement can contact the counter-contact faces of the counter-arrangement, without being scraped. Nonetheless, in an advantageous embodiment of the method, the contact face of the arrangement may wipe over the counter-contact face of the counter-arrangement during contacting counter to the displacement direction, for example, in order to carry away contamination which occurs during the production process. If desirable, the contact face can also move with relatively high pressure over the counter-contact face and rub against it. It is thereby possible to remove, for example, thin oxide layers.

The invention is explained in greater detail below by way of example with reference to advantageous embodiments and with reference to the drawings. The embodiments described are only possible embodiments, in which, however, the individual features, as described above, can be combined or omitted independently of each other.

DETAILED DESCRIPTION OF THE DRAWINGS

Figure 1:
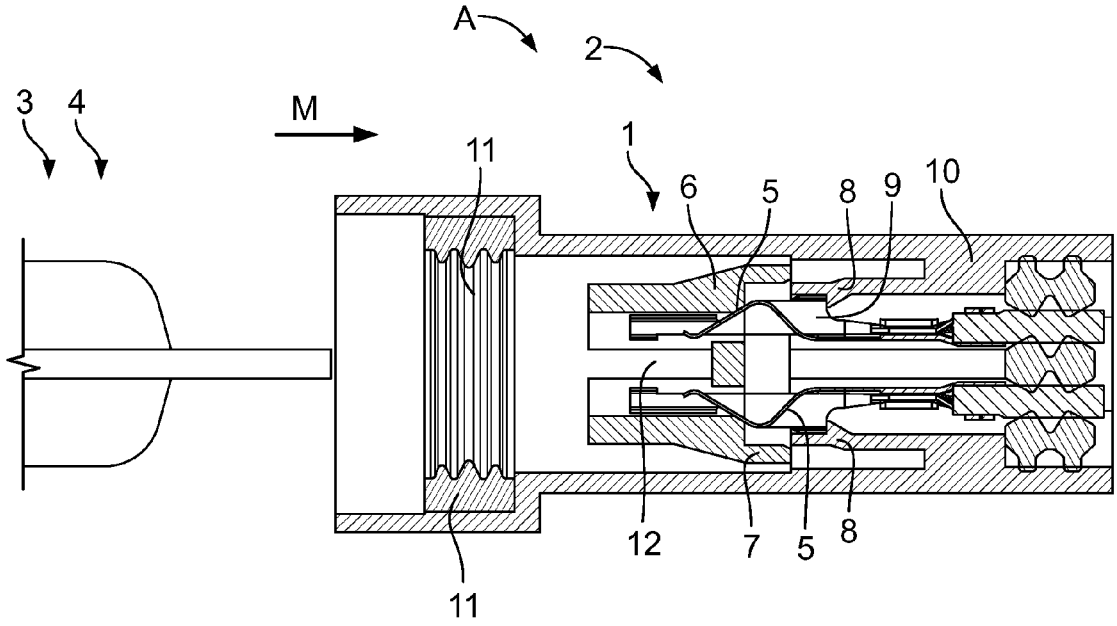
FIG. 1 is a schematic cross-section through an arrangement according to the invention as part of a connector together with a counter-arrangement in a start position.

FIG. 1 shows an arrangement 1 for electrical contacting at the right-hand side. It is part of a connector 2. The arrangement can be connected to a counter-arrangement 3 which is illustrated in this instance by a printed circuit board 4. To this end, the counter-arrangement 3 is introduced into the connector 2 in a displacement direction M. FIG. 1 shows a start position A in which the arrangement 1 is not yet in contact with the counter-arrangement 3.

The arrangement 1 comprises a plurality of contact arms 5 which can be resiliently redirected transversely relative to the displacement direction M. The contact arms 5 are located facing each other with respect to the displacement direction M. They are associated with two different sides of the printed circuit board 4.

The arrangement 1 further comprises a counter-element 6 which is displaceably retained on the contact arms 5 parallel with the contact arms 5 which extend in the displacement direction M.

The counter-element 6 is rigidly connected to contact securing means 7. The contact securing means 7 prevent retention arms 8 which serve to retain contact elements 9 in a connector housing 10 from being redirected. In the start position A shown, the counter-element 6 is not yet completely inserted into the connector housing 10 and the contact securing means 7 do not yet engage behind or block the retention arms 8. The contact securing means 7 thus do not yet secure the contact elements 9.

The connector 2 further has a seal 11, with which the inner side of the connector 2 is sealed when the connector 2 is connected to the counter-arrangement 3.

Figure 2:
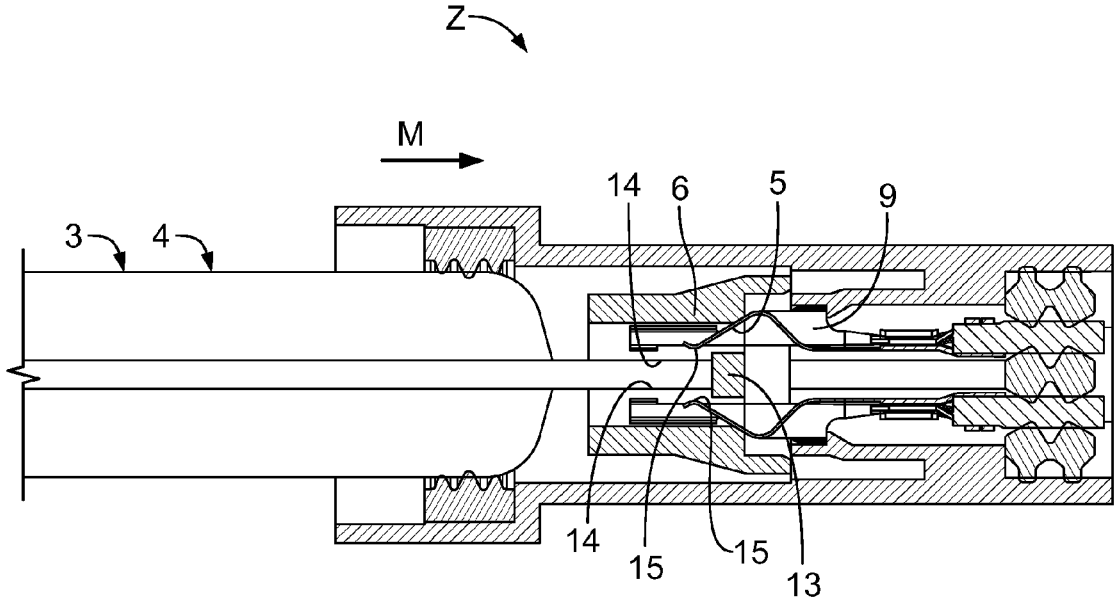
FIG. 2 is a schematic cross-section through the arrangement and counter-arrangement of FIG. 1 in an intermediate position.

FIG. 2 illustrates an intermediate position Z. In the intermediate position Z, the counter-arrangement 3 is partially inserted into the connector 2. A piece of the counter-arrangement 3 fills a recess 12 of the arrangement 1 and strikes a counter-stop 13. However, the counter-element 6 has not yet moved in the displacement direction M with the counter-arrangement 3. The contact arms 5 are still in the same position as in the start position A from FIG. 1. In the previous displacement operation, the contact arms 5 have not yet touched the counter-arrangement 3. Contact faces 15 which are arranged at the ends of the contact arms 5 are still not yet in contact with counter-contact faces 14 on the counter-arrangement 3. The contact faces 15 are still inside the contact elements 9.

Figure 3:
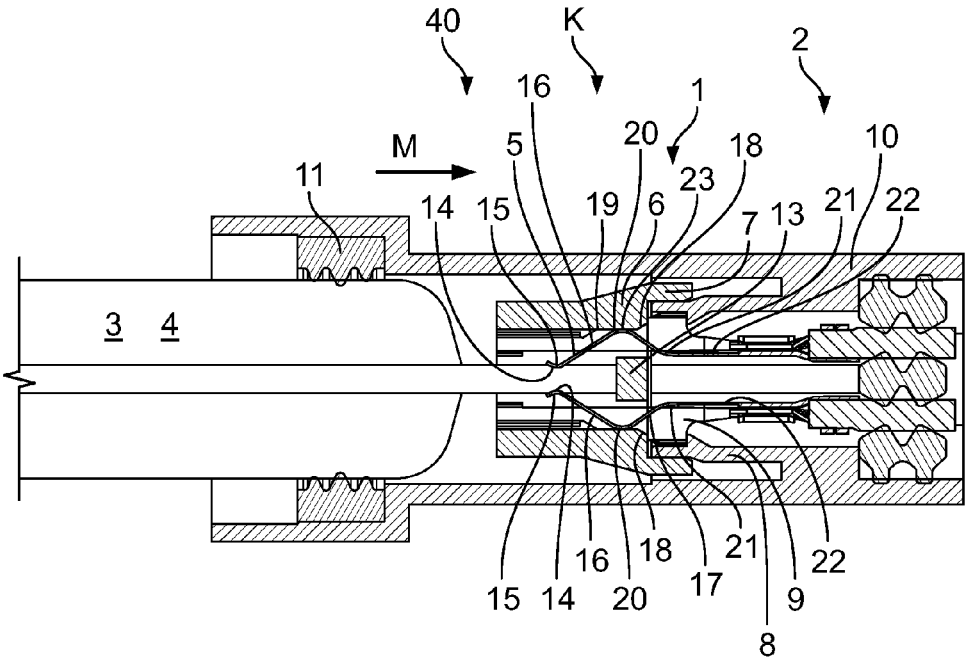
FIG. 3 is a schematic cross-section through the arrangement and counter-arrangement of FIGS. 1 and 2 in a contact position.

In FIG. 3, the arrangement 1 is illustrated together with the counter-arrangement 3 in a contact position K. The counter-arrangement 3 is connected to the arrangement 1. Together, they form a plug type connection 40. The counter-arrangement 3 has been pushed in the displacement direction M into the connector 2 and has carried the counter-element 6 on the stop 13 in the displacement direction M. Two redirection portions 16 which extend in an oblique manner with respect to the displacement direction have been redirected onto the counter-arrangement 3 transversely relative to the displacement direction M by two counter-faces 18 of a counter-element 6 which also extend in an oblique manner with respect to the displacement direction M. The contact faces 15 which are arranged at the ends of the redirection portions 16 now contact the counter-contact faces 14 on the counter-arrangement 3.

The redirection portions 16 are connected to pivot portions 17 by means of curved portions 20. The pivot portions 17 are in turn fitted to a base 22 by means of curved portions 21.

The pivot portion 17 and the redirection portion 16 together form a V-shape. This configuration is particularly compact in a direction transverse relative to the displacement direction M. Furthermore, the configuration of an inner counter-face 19 in a manner parallel with the displacement direction M ensures together with the tip 23 of the V that the contact arm 5 applies a contact force to the counter-contact face 14 that remains consistent over a specific portion since a small displacement of the counter-element 6 from the contact position K does not lead to a changed redirection of the contact arm 5.

In the contact position K shown here, the contact faces 15 of the contact arms 5 are less spaced apart from each other than in the start position A and in the intermediate position Z. In the method according to the invention for joining together, the contact faces 15 of the arrangement 1 are contacted on the counter-contact faces 14 of the counter-arrangement 3 without being scraped or abraded. The contacting is carried out transversely relative to the displacement direction M. The contact faces 15 are placed on the counter-contact faces 14. Nonetheless, the contact faces 15 can still be displaced counter to the displacement direction M during the contacting and wipe dirt from the counter-contact faces 14 or rub against them. During this wiping movement, the free end of the contact arms 5 is moved with the contact faces 15 counter to the displacement direction on the counter-contact faces 14. In this instance, the angle of the V-shape which is formed by the pivot portion 17 and the redirection portion 16 increases. The opposing base 22 is supported in a fixed manner. A contacting can thereby take place with little resistance.

In the contact position K, and also in the intermediate position Z, the inner side of the connector 2 is sealed by the seal 11.

Furthermore, the counter-element 6 performs a dual function in the contact position K since the contact securing means 7 which are integral with the counter-element 6 and which may be understood to be part of the counter-element 6 secure the contact elements 9 against falling out in the connector housing. To this end, the contact securing means 7 engage behind the retention arms 8 at least partially and block a redirection of the retention arms 8 transversely relative to the displacement direction M.

The counter-element 6 serves at the same time to redirect the two contact a 5. It is pushed in the manner of a carriage or a sleeve over the contact elements 9.

The drawings of FIGS. 1 to 3 show two contact elements 9 with a contact arm 5, respectively. Of course, more contact elements 9 or only one contact element 9 may also be fitted in the connector 2. These may, for example, be located with respect to the plane of the drawing in front of or behind the contact elements 9 shown. Advantageously, the counter-element 6 redirects all the contact elements 9 at the same time.

Figure 4:
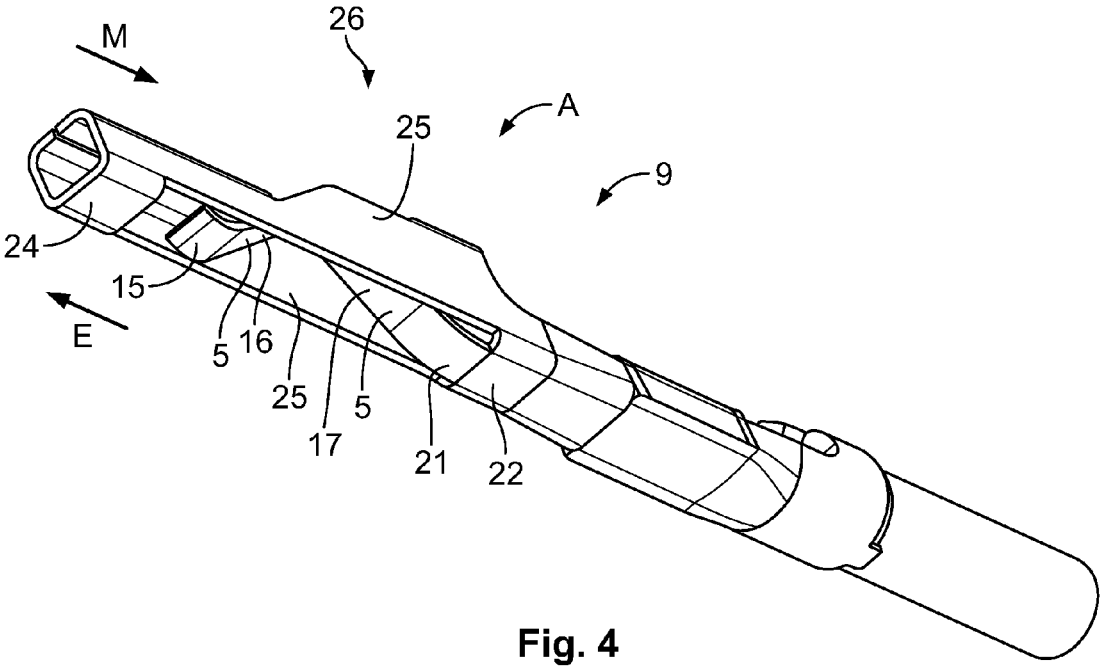
FIG. 4 is a schematic perspective view of a contact element according to the invention.
Figure 5:
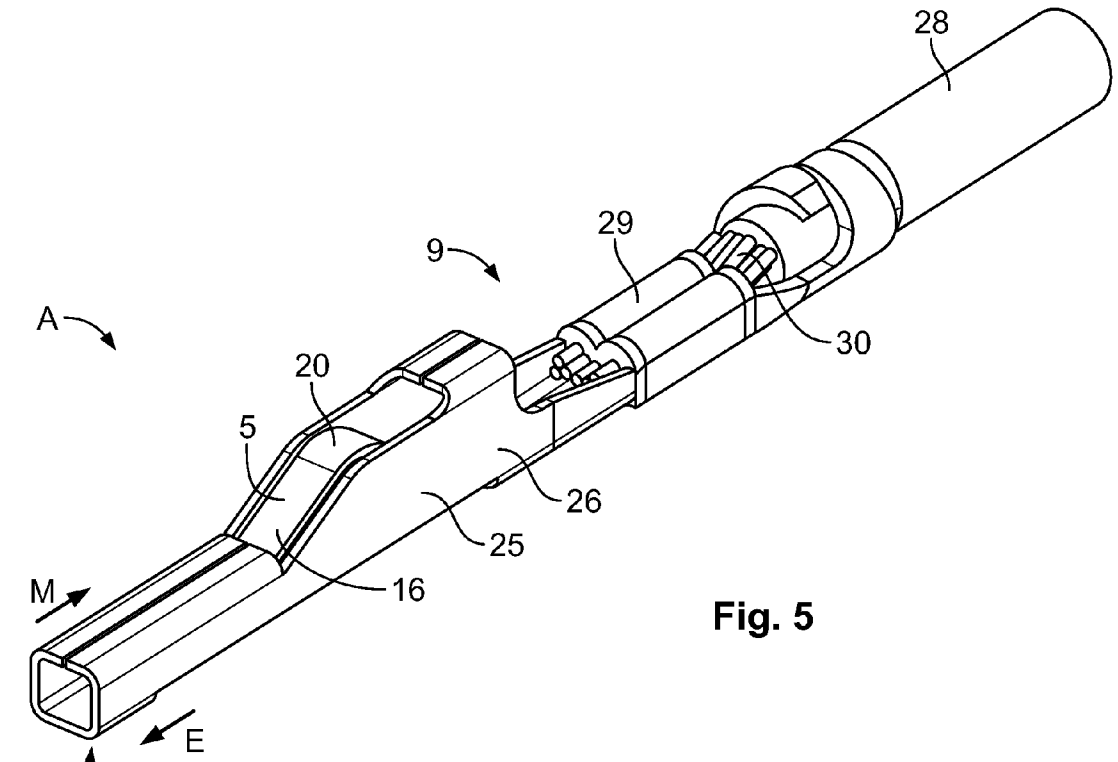
FIG. 5 is another schematic, perspective view of the contact element of FIG. 4.
Figure 6:
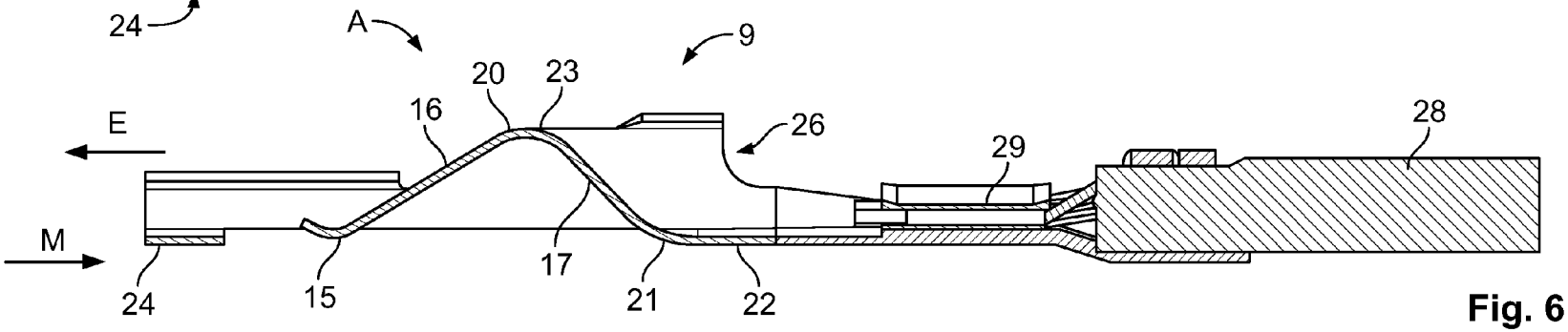
FIG. 6 is a schematic longitudinal section through the contact element from FIGS. 4 and 5.

FIGS. 4 to 6 illustrate a contact element 9 according to the invention with a contact arm 5 individually.

In FIG. 4, the contact element 9 can be seen from below. In an insertion direction E, the contact element 9 may, for example, be inserted into a connector housing 10. This insertion direction E may extend parallel and counter to the displacement direction M, along which the counter-element 6 is displaced. In order to protect the contact face 15 during the insertion operation and when the counter-element 6 is fitted, the contact element 9 has a protection element 24 which covers the contact face 15, when viewed in the insertion direction E and in the displacement direction, at least in the start position A. The protection element 24 is constructed as a protection wall in this instance. In the contact position K, the contact face 15 may project beyond the protection element 24 transversely relative to the insertion direction E and the displacement direction M.

In order to further protect the contact arm 5, the contact element 9 has side walls 25 which cover the contact aim 5 in the start position A.

The protection element 24 and the side walls 25 are part of a contact housing 26 which protects the contact arm 5. In the start position A, the contact arm 5 is located inside the housing 26. In particular, it is located inside a cubing of the housing 26, that is to say, a surrounding face. In the contact position K, the contact arm 5, in particular the contact face 15, may protrude from the housing 26, that is to say, from the cubing of the housing 26.

The contact housing 26 is integral with the contact arm 5. The entire contact element 9 is a punched portion which has been punched from a metal sheet and which has been shaped by means of bending.

In FIG. 5, the contact element 9 can be seen from above. The contact element 9 is connected to a cable 28. A connection portion 29 is constructed as a crimp portion, which retains strands 30 of the cable 28.

It is also possible to see the redirection portion 16 which extends in an oblique manner with respect to the displacement direction M and on which the counter-element is advanced in the contact position K. The redirection portion 16 is also protected by means of the side walls 25.

FIG. 6 is a sectioned illustration of the contact element 9. The pivot portion 17 is articulated to a base 22 by means of a curved portion 21. The redirection portion 16 is in turn articulated to the pivot portion 17 by means of a curved portion 20. Owing to this embodiment, the redirection portion 16 can be redirected in a simple manner transversely relative to the displacement direction M. The contact arm 5 is thereby compact transversely relative to the displacement direction M. Owing to the tip 23 which faces the contact face 15, in the event of abutment with a counter-face 19 which extends parallel with the displacement direction M, a consistent contact force and redirection are ensured.

| List of reference numerals | |
|---|---|
| 1 | Arrangement |
| 2 | Connector |
| 3 | Counter-arrangement |
| 4 | Printed circuit board |
| 5 | Contact arm |
| 6 | Counter-element |
| 7 | Contact securing means |
| 8 | Retention arm |
| 9 | Contact element |
| 10 | Connector housing |
| 11 | Seal |
| 12 | Recess |
| 13 | Stop |
| 14 | Counter-contact face |
| 15 | Contact face |
| 16 | Redirection portion |
| 17 | Pivot portion |
| 18 | Counter-face |
| 19 | Counter-face |
| 20 | Curved portion |
| 21 | Curved portion |
| 22 | Base |
| 23 | Tip |
| 24 | Protection element |
| 25 | Side wall |
| 26 | Contact housing |
| 28 | Cable |
| 29 | Connection portion |
| 30 | Strands |
| 40 | Plug type connection |
| A | Start position |
| E | Insertion direction |
| K | Contact position |
| M | Displacement direction |
| Z | Intermediate position |

What is claimed is:

1. An electrical connector, comprising:

a contact element comprising a resiliently redirectable contact arm having a contact face, the contact element comprising side walls which cover the arms in a start position, wherein the contact arm extends to a displacement direction, a counter-element which can be displaced parallel to the contact arm upon insertion of a mating element, wherein the counter-element is displaced with respect to the start position (A) to a contact position (K) and the contact arm is thereby resiliently redirected transversely relative to a displacement direction (M) of the counter-element, and a counter-stop, coupled to the counter element which under the influence of the insertion of the mating element, moves the counter element, to deflect the contact arm;

wherein the contact arm is positioned intermediate the counter-stop and the counter-element, the counter-element moving the contact arm towards the counter-stop when in the contact position (K).

2. The electrical connector according to claim 1, wherein the counter-element is displaceably retained on the contact arm.

3. The electrical connector according to claim 1, wherein the contact element comprises a protection element which, in the start position (A), covers the contact face when viewed in an insertion direction (E) and/or in the displacement direction (M).

4. The electrical connector according to claim 1, wherein the contact element comprises a contact housing, wherein the contact arm is located inside the contact housing in the start position (A).

5. The electrical connector according to claim 1, wherein the contact arm has a redirection portion which extends in an oblique manner relative to the displacement direction (M) and which can be redirected relative to a base, and the counter-element is advanced onto the redirection portion in the contact position (K).

6. The electrical connector according to claim 5, wherein the contact arm has a pivot portion which is articulated to a base by means of a curved portion.

7. The electrical connector according to claim 6, wherein the redirection portion and the pivot portion together form a V-shape whose tip faces the contact face transversely relative to the displacement direction (M).

8. The electrical connector according to claim 1, wherein the contact element has two contact arms whose contact faces in the start position (A) are spaced further apart from each other than in the contact position (K).

9. The electrical connector according to claim 8, wherein both contact arms are redirected with the same counter-element.

10. The electrical connector according to claim 1, further comprising retention arms to retain the contact element wherein the counter-element is rigidly connected to a securing device, which engages behind the retention arms when in the contact position (K).

11. An electrical connection, comprising an electrical connector according to claim 1 and wherein the electrical connector is electrically connected to electrical contacts on the mating element.

12. The plug type connection according to claim 11, wherein the counter-element is rigidly connected to the counter stop.

13. An electrical connector, comprising:

a housing having a front face with an opening;

a contact element comprising a resiliently redirectable contact arm having a contact face, the contact element being positioned within the housing and wherein the contact arm extends to a displacement direction, a counter-element positioned within and movable relative to the housing, the counter element including a recess at a front end thereof for receiving a mating electrical element and a cavity to receive the contact element, the counter element being displaceable parallel to the contact arm upon insertion of the mating electrical element, wherein the counter-element is displaced with respect to the start position (A) to a contact position (K) and the contact arm is thereby resiliently redirected transversely relative to a displacement direction (M) of the counter-element from a position in the cavity to a position towards the recess, and a counter-stop, coupled to the counter element which under the influence of the insertion of the mating element, moves the counter element, to deflect the contact arm.

14. The electrical connector according to claim 13, wherein the contact element has two contact arms whose contact faces in the start position (A) are spaced further apart from each other than in the contact position (K).

15. The electrical connector according to claim 14, wherein the contact faces of both contact arms are spaced further apart than the recess.

16. The electrical connector according to claim 14, wherein both contact arms are redirected with the same counter-element.

* * * * *